US005289653A

United States Patent [19]

Szebeni et al.

[11] Patent Number: 5,289,653

[45] Date of Patent: Mar. 1, 1994

[54] FIREARM LOCKING DEVICE

[76] Inventors: Laszlo L. Szebeni, 21 Margo Ct.; Ludovic Biro, 1224 Cromwell Hills Dr., both of Cromwell, Conn. 06416

[21] Appl. No.: 998,514

[22] Filed: Dec. 30, 1992

[51] Int. Cl.[5] ..... F41A 17/44

[52] U.S. Cl. ..... 42/70.11

[58] Field of Search ..... 42/70.11, 70.01

[56] References Cited

U.S. PATENT DOCUMENTS 2,479,107 8/1949 Garretson ..... 42/70.11

5,138,785 8/1992 Paterson ..... 42/70.11

5,171,924 12/1992 Honey et al. ..... 42/70.11

*Primary Examiner*—David H. Brown

*Attorney, Agent, or Firm*—McCormick, Paulding & Huber

[57] ABSTRACT

A firearm locking device has a sleeve made of a resilient material with a collet formed at one end. With the one end of the sleeve inserted through the muzzle into the barrel of the firearm, the collet extends into the cartridge-receiving chamber of the firearm and the opposite end of the sleeve projects from the muzzle. An elongated element with an eccentric at one end is inserted in the sleeve, and when rotated by a lock cylinder, the eccentric expands the collet in the cartridge chamber and insures that no live cartridge is present in or is loaded into the chamber. An adapter allows the locking device to accommodate barrels of different length.

8 Claims, 2 Drawing Sheets

FIREARM LOCKING DEVICE

BACKGROUND OF THE INVENTION

The present invention relates generally to firearm locking devices, particularly for revolvers and automatic pistols.

DESCRIPTION OF PRIOR ART

Several prior art patents share with the present invention the common concept of providing a conventional lock cylinder adjacent the muzzle end of the firearm, and include provision for inserting an elongated locking device inside the barrel and the chamber in order to disable the firearm. See for example U.S. Pat. Nos. 4,512,099, 2,887,807 and 2,327,334. U.S. Pat. No. 4,512,099 shows a split wedge in the firing chamber, and requires axial movement of the elongated element inserted in the barrel. U.S. Pat. No. 2,887,807 provides for rotation of an elongated element in a sleeve but fails to show the unique sleeve expanding capability of the present invention. U.S. Pat. No. 2,327,334 suggests rotating an elongated element in the gun barrel, but the rotation is not created by rotation of the lock cylinder.

SUMMARY OF THE INVENTION

In accordance with the present invention an elongated sleeve is provided inside the bore of the barrel such that an inner end of the sleeve extends into the chamber, and an elongated element is provided inside the sleeve such that an inner portion of the elongated element has an eccentric cross section that cooperates with protuberances on the inside diameter of the sleeve to cause the sleeve inner end to deform radially outwardly when the elongated element is rotated relative to the sleeve from an unlocked to a locked position, preferably by turning a key in a conventional lock cylinder one quarter of a turn.

A primary object of the present invention is to provide a device in the firearm barrel that is operable by a quarter turn of a key in a lock cylinder. The device disclosed provides for positive deformation of the inner end of the tubular sleeve. The entire device can be inserted from the muzzle end of the barrel, without the need for providing any component in the firearm chamber from the cartridge loading end thereof.

DETAILED DESCRIPTION

Figure 1:
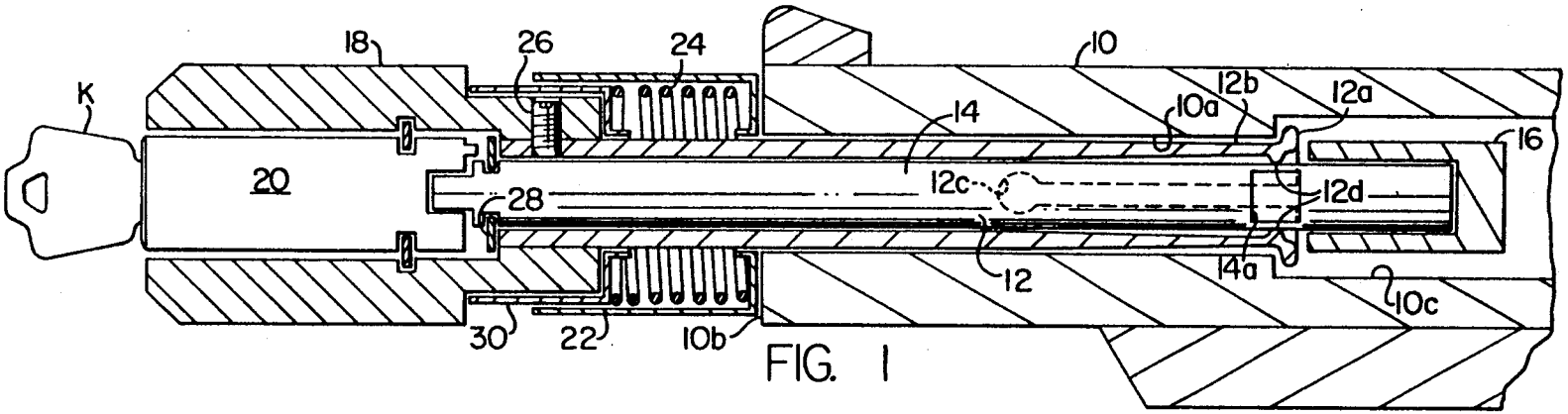
FIG. 1 is a longitudinal sectional view showing in elevation a device constructed in accordance with the present invention.

FIG. 1 shows the muzzle end of a firearm with the barrel indicated generally at 10, and with a bore defined in the barrel as suggested generally at *10a*. The bore extends from the muzzle end of the barrel 10*b* to a receiving chamber 10*c* which may be defined by the barrel, or by another component of the firearm, as for example, a rotating cylinder in the case of a revolver. It is important to note that the firearm 10 is of conventional geometry and the device to be described is intended for use the firearms generally but is particularly useful in connection with pistols and revolvers or the like.

Figure 4:
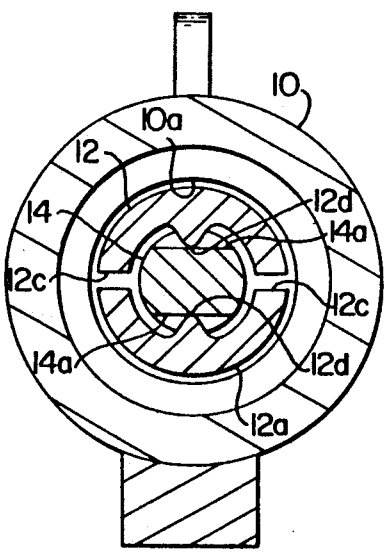
FIG. 4 is a sectional view taken generally on the line 4—4 of FIG. 2.
Figure 2:
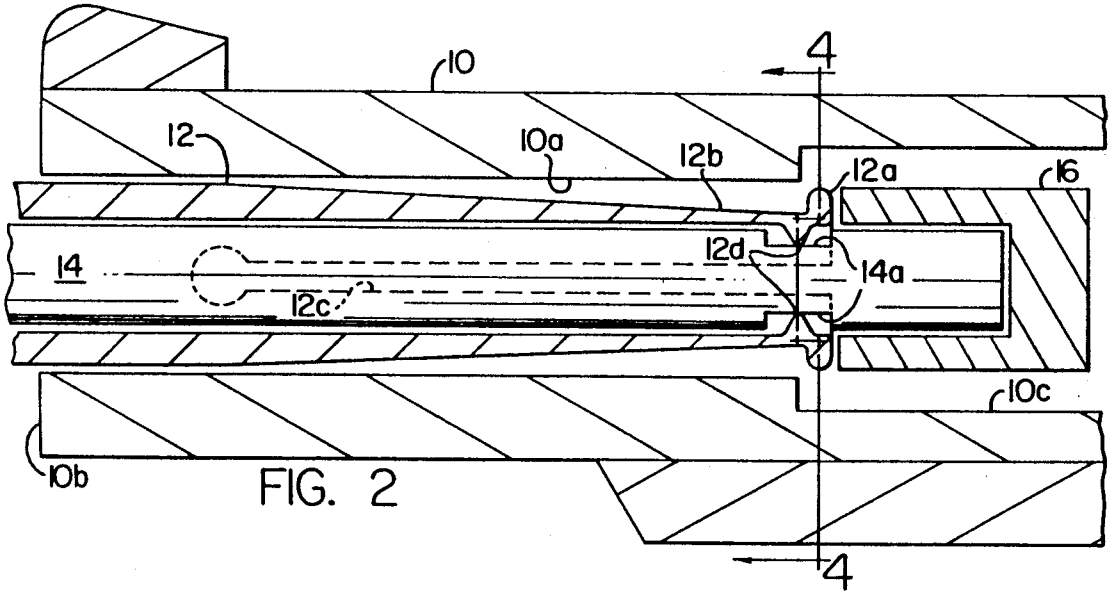
FIG. 2 illustrates the inner end of the device of FIG. 1 inserted into the bore of a firearm barrel with the components in an unlocked position.

FIG. 2 illustrates in exploded relationship the portion of a firearm locking device that is adapted to be received in the bore 10*a* of the barrel 10. The locking device includes a tubular sleeve having a length somewhat longer than the barrel bore such that an inner end of the sleeve 12*a* actually extends into the chamber 10*c* when the sleeve is provided inside the barrel bore as shown. The sleeve 12 has an inner portion 12*b* that is necked down somewhat to reduce the radial dimension of the sleeve in the area of the sleeve inner end 12*a*. As best shown in FIG. 4 this inner portion of the sleeve 12 also defines slots 12*c* which further reduce the stiffness of the sleeve 12 in the area of its inner portion. As so constructed and arranged the inner portion of the sleeve 12 defines a collet. This collet is expandable radially to grip the interior of the barrel bore and more particularly to grip the area between the inner end of the barrel bore and the receiving chamber 10*c*.

Figure 5:
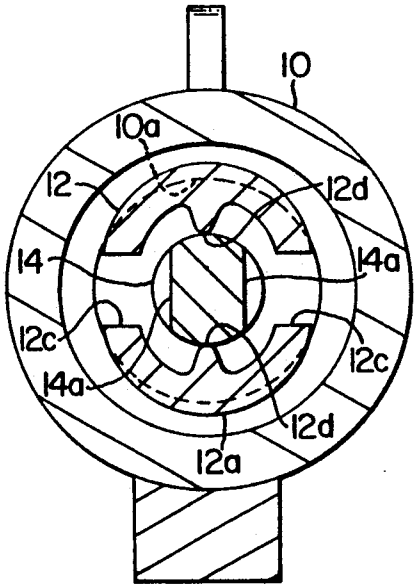
FIG. 5 is a sectional view taken generally on the line 5—5 of FIG. 3.
Figure 3:
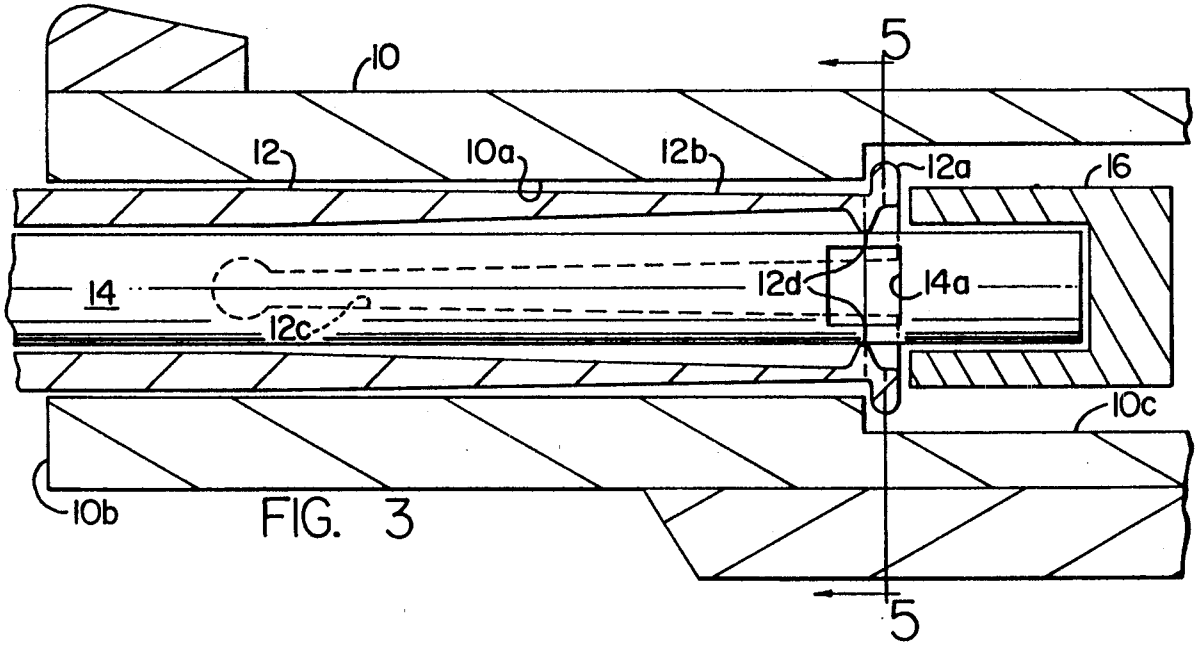
FIG. 3 is a view similar to FIG. 2, but illustrating the components in a locked position.

In order to achieve this gripping action of the collet defined at the inner end of the sleeve 12 an elongated element 14 is provided inside the sleeve 12 and is adapted to be rotated relative thereto by the locking device to be described. The inner end of the elongated element 14 is provided with relieved recesses 14*a*, 14*a* which normally receive radially inwardly projecting protuberances 12*d*, 12*d* on the inside diameter of the sleeve 12. However, rotation of the elongated element 14 relative to the sleeve 12 results in a biasing action as between the elongated element 14 and the sleeve 12 as suggested in FIGS. 3 and 5. More specifically, rotation of the elongated element 14 through 90 degrees or a quarter turn relative to the sleeve 12 achieves this locking action as between the inner end of the sleeve 12 and the junction between the barrel bore and the receiving chamber.

The inner end of the elongated element 14 extends beyond the inner end of the sleeve 12 and carries a plastic cap 16 which cap has an external diameter equal to the external diameter of the sleeve 12. As so constructed and arranged the entire assembly can be inserted at the muzzle end of the barrel with the above described elements unlocked. The cap 16 occupying the firing chamber to preclude leaving a live cartridge in the chamber when securing the weapon with the device of the present invention. The locking action achieved as a result of merely rotating the elongated element 14 relative to the sleeve 12 through a quarter turn or 90 degrees results in an effective means for preventing use of the firearm.

Turning now to FIG. 1 in greater detail, a conventional lock cylinder and lock cylinder shell are mounted to the outer end of the elongated element 14 and to the outer end of the sleeve 12 respectively so as to provide for the 90 degree motion or quarter turn only through the medium of a conventional key K. The lock cylinder 20 and shell 18 are of conventional configuration, and in accordance with conventional lock cylinders generally means is provided at the tail end of the lock cylinder to limit rotation of the lock cylinder relative the shell to 90 degrees even when the key K is inserted. Furthermore, the key K can be removed from the lock cylinder only when the lock cylinder and shell are in a locked position, corresponding to the locked position of the inner end of the elongated element relative to the inner end of the elongated sleeve 12 as described previously.

An optional feature of the present invention is that the locking device of FIG. 1 can be used with firearms of various barrel length. An adapter 22 of annular configuration is provided between the lock cylinder shell 18 and the muzzle end 10*b* of the firearm barrel 10. This adapter 22 includes a compression spring 24 acting at one end on the annular adapter 22 adjacent the muzzle end 10*b* of the barrel and acting at its opposite end against a necked down portion of the lock cylinder shell 18. The adapter 22 has a telescoping fit along the necked down portion of the lock cylinder shell 18 and as a result it will be apparent that the device can be adapted for use in connection with firearms of various barrel lengths.

The outer end of the sleeve 12 is secured to the lock cylinder shell 18 by a set screw 26 as shown in FIG. 1. The outer end of the elongated element or rod 14 is secured to the tail end of the lock cylinder 20 by providing a non-circular opening in the tail end of the lock cylinder and a corresponding configured tang on the outer end of the elongated rod 14 as shown. A retaining ring 28 is provided for positioning the elongated element or rod 14 relative to the sleeve 12 and relative to the lock cylinder assembly. In order to prevent tampering with the set screw 26 when the device is locked in the firearm barrel (FIG. 1) a cup-shaped annular cover 30 is provided around the inner end of the shell 18 and the annular shape of this cover includes an inner portion that is engaged by the spring 24 to hold the cover 30 in the position shown for it in FIG. 1. As so positioned this cover 30 prevents access to the set screw 26.

We claim:

1. A firearm locking device for use with a firearm having a barrel and a cartridge receiving chamber communicating with a bore of the barrel, said device comprising:

a sleeve of resilient material and having a length somewhat longer than said barrel bore such that an inner end of said sleeve extends into the chamber when said sleeve is provided inside said barrel, an elongated element rotatably received inside said sleeve and having an inner end portion of eccentric cross section such that it cooperates with the inside of said sleeve to cause said sleeve inner end to deform radially outwardly when said elongated element is rotated relative said sleeve from an unlocked to a locked angular position, and said sleeve inner end being of non-circular cross sectional shape such that at least one radially inwardly projecting protuberance is adapted to be angularly aligned with said eccentric inner end portion of said elongated element to define said locked angular position of said elongated element, and a plastic cap provided on the inner end of said elongated element, said cap having an outside diameter of at least approximately equal to that of said sleeve outside diameter, said sleeve inner end defining at least one slot to facilitate radial deformation thereof by rotation of said elongated element.

2. The device according to claim 1 wherein said sleeve has a portion adjacent said inner end of reduced radial thickness to facilitate radial deformation of said inner end by rotation of said elongated element.

3. The device according to claim 1 further characterized by a lock cylinder and a lock cylinder outer shell, said shell and cylinder defining a key slot for receiving a key that is adapted to allow at least limited angular movement of said cylinder relative to said shell, said shell secured to said sleeve and said cylinder secured to said elongated element.

4. A firearm locking device for use with a firearm having a barrel and a cartridge receiving chamber communicating with a bore of the barrel, said device comprising:

a sleeve of resilient material and having a length somewhat longer than said barrel bore such that an inner end of said sleeve extends into the chamber when said sleeve is provided inside said barrel, an elongated element rotatably received inside said sleeve and having an inner end portion of eccentric cross section such that it cooperates with the inside of said sleeve to cause said sleeve inner end to deform radially outwardly when said elongated element is rotated relative said sleeve from an unlocked to a locked angular position, a lock cylinder and a lock cylinder outer shell, said shell and cylinder defining a key slot for receiving a key that is adapted to allow at least limited angular movement of said cylinder relative to said shell, said shell secured to said sleeve and said cylinder secured to said elongated element, and said sleeve having an outer portion projecting beyond the muzzle end of the barrel, and said sleeve having an outer end secured to said lock shell, an annular adapter slidably received on said sleeve outer portion, and a spring biasing said adapter away from said lock cylinder shell toward said muzzle end of said barrel whereby the device can be used on firearms of varying barrel length.

5. The device according to claim 4 wherein said sleeve has a portion adjacent said inner end of reduced radial thickness to facilitate radial deformation of said inner end by rotation of said elongated element.

6. The device according to claim 4 wherein sleeve inner end is of non-circular inside cross section shape such that at least one radially inwardly projecting protuberance is adapted to be angularly aligned with said eccentric inner end portion of said elongated element to define said locked angular position of said elongated element.

7. A firearm locking device for use with a firearm having a barrel and a cartridge receiving chamber communicating with a bore of the barrel, said device comprising:

a sleeve of resilient material having a length somewhat longer than the barrel bore such that an inner end of said sleeve extends near the chamber when the sleeve is provided inside the barrel;

an elongated element rotatably received inside said sleeve and having an inner end portion of eccentric cross section such that it cooperates with the inside of said sleeve to cause said sleeve inner end to deform radially outwardly when said elongated element is rotated per 90 degrees inside said sleeve, elongated element being rotatable through an angular range of at least approximately 90 degrees from locked to unlocked positions;

a lock cylinder and shell assembly also rotatable through at least approximately 90 degrees;

said sleeve having an outer portion projecting beyond the muzzle end of the barrel, and said sleeve having an outer end secured to said outer shell, an annular adapted slidably received on said sleeve outer portion, means biasing said adapter away from said outer shell toward said muzzle end of said barrel whereby the device can be used on firearms of varying barrel length.

8. The device according to claim 7 further characterized by a plastic cap provided on the inner end of said elongated element, said cap having an outside diameter at least approximately equal to that of said sleeve outside diameter, and said sleeve inner end defining at least one slot to facilitate radial deformation thereof by rotation of said elongated element.

* * * * *